US007179776B2

(12) United States Patent
Hahn

(10) Patent No.: US 7,179,776 B2
(45) Date of Patent: Feb. 20, 2007

(54) CERAMIC DISHWASHING COMPOSITION FOR INHIBITING CORROSION OF GLASSWARE

(75) Inventor: Karlheinz Ulrich Gerhard Hahn, Otterstadt (DE)

(73) Assignee: Reckitt Benckiser, N.V., Hoofddorp (NL)

( * ) Notice: Subject to any disclaimer, the term of this patent is extended or adjusted under 35 U.S.C. 154(b) by 0 days.

(21) Appl. No.: 10/848,477

(22) Filed: May 18, 2004

(65) Prior Publication Data

US 2004/0220068 A1 Nov. 4, 2004

Related U.S. Application Data

(60) Division of application No. 10/234,419, filed on Sep. 3, 2002, now Pat. No. 6,806,245, which is a continuation of application No. PCT/GB01/00910, filed on Mar. 2, 2001.

(30) Foreign Application Priority Data

Mar. 2, 2000 (DE) ..... 100 10 209

(51) Int. Cl.
*C11D 7/10* (2006.01)

(52) U.S. Cl. ..... 510/232; 510/220; 510/224; 510/507; 510/511; 510/514

(58) Field of Classification Search ..... 510/220, 510/224, 232, 507, 511, 514
See application file for complete search history.

(56) References Cited

U.S. PATENT DOCUMENTS

| | | | | |
|---|---|---|---|---|
| 3,255,117 | A | 6/1966 | Knapp et al. | |
| 3,668,094 | A * | 6/1972 | Hatch | 252/180 |
| 3,677,820 | A | 7/1972 | Rutkowski et al. | |
| 4,088,502 | A * | 5/1978 | La Bar | 501/124 |
| 4,346,184 | A * | 8/1982 | Drake | 523/451 |
| 4,454,358 | A * | 6/1984 | Kummer et al. | 568/885 |
| 4,561,896 | A * | 12/1985 | Drake et al. | 106/14.12 |
| 4,908,148 | A * | 3/1990 | Caravajal et al. | 510/514 |
| 4,917,812 | A | 4/1990 | Cilley | |
| 4,933,101 | A | 6/1990 | Cilley et al. | |
| 5,080,863 | A * | 1/1992 | Gray | 422/14 |
| 5,135,675 | A | 8/1992 | Elliott et al. | |
| 5,179,047 | A * | 1/1993 | Chiba | 501/15 |
| 5,391,771 | A * | 2/1995 | Weyer et al. | 549/326 |
| 5,624,892 | A | 4/1997 | Angevaare et al. | |
| 5,783,539 | A | 7/1998 | Angevaare et al. | |
| 5,792,360 | A * | 8/1998 | Algar | 210/697 |

FOREIGN PATENT DOCUMENTS

| | | |
|---|---|---|
| DE | 198 60 670 A1 | 8/2000 |
| EP | 0 383 480 A1 | 8/1990 |
| EP | 0 383 482 A2 | 8/1990 |
| EP | 0 383 482 A3 | 8/1990 |
| EP | 0 383 482 B1 | 8/1990 |
| EP | 0 387 997 A2 | 9/1990 |
| EP | 0 387 997 A3 | 9/1990 |
| EP | 0 387 997 B1 | 9/1990 |
| FR | 2 748 751 A1 | 11/1997 |
| GB | 1442885 | 7/1976 |
| WO | WO 00/39259 A1 | 7/2000 |
| WO | WO 00/56851 A1 | 9/2000 |

OTHER PUBLICATIONS

*Römpp-Lexicon Chemise* [Römpp Chemical Dictionary], vol. 3, pp. 2113-2114 (1997).
*Römpp-Lexicon Chemise* [Römpp Chemical Dictionary], vol. 2, pp. 1538-1545 (1997).

* cited by examiner

*Primary Examiner*—Charles Boyer
(74) *Attorney, Agent, or Firm*—Akin Gump Strauss Haver & Feld, LLP

(57) ABSTRACT

A ceramic composition is provided to protect glassware from corrosion in a dishwasher. The ceramic composition contains at least one compound which releases an active agent during washing and/or rinsing cycles of a dishwasher to protect glassware from corrosion.

3 Claims, No Drawings

CERAMIC DISHWASHING COMPOSITION FOR INHIBITING CORROSION OF GLASSWARE

CROSS-REFERENCE TO RELATED APPLICATIONS

This application is a division of U.S. patent application Ser. No. 10/234,419 filed Sep. 3, 2002 now U.S. Pat. No. 6,806,245, which is a continuation of International Patent Application No. PCT/GB01/00910, filed Mar. 2, 2001, which was published in the English language on Sep. 7, 2001, under International Publication No. WO 01/64823, and the disclosure of which is incorporated herein by reference.

BACKGROUND OF THE INVENTION

The invention relates to a new type of use for a ceramic composition to protect glassware from corrosion during washing and/or rinsing cycles of a dishwasher, compositions intended for use in a dishwasher for the aforesaid purpose, and a method of inhibiting the corrosion of glassware during washing and/or rinsing cycles of a dishwasher.

The problem of glassware corroding during washing and/or rinsing cycles of a dishwasher has long been known. Current opinion is that the problem of corrosion in glassware is the result of two separate phenomena. On the one hand, the corrosion is clearly due to minerals from the glass composition accompanied by hydrolysis of the silicate network. On the other hand, silicate material is released from the glass. After several washes in a dishwasher, both phenomena can cause damage to glassware, such as cloudiness, scratches, streaks, and the like.

Silicate compounds are known to be effective in preventing minerals from being released from the glass composition, but on the other hand can tend to increase the separation of silicate material at the surface of the glass.

Various proposals have been put forward as a means of dealing with the problems described above.

One approach is to use zinc, either in metallic form (U.S. Pat. No. 3,677,820) or in the form of zinc compounds. The use of soluble zinc salts as a means of preventing the corrosion of glassware in dishwasher cleansers is described in U.S. Pat. No. 3,255,117, for example.

Because of a number of disadvantages inherent in using soluble zinc salts (in particular the formation of a precipitate of insoluble zinc salts with other ions in the washing or rinsing water), European patent applications EP 0 383 480, EP 0 383 482 and EP 0 387 997 propose the use of insoluble zinc compounds as a means of inhibiting corrosion of glassware in automatic dishwashers. Specifically, the insoluble zinc salts proposed are zinc silicate, zinc carbonate, zinc oxide, basic zinc carbonate (approximately: $Zn_2(OH)_2CO_3$), zinc hydroxide, zinc oxalate, zinc monophosphate, $Zn_3(PO_4)_2$), and zinc pyrophosphate $Zn_2(P_2O_7)$). If using zinc salts of this type in granular cleansing compounds, the insoluble zinc compound is specified as having a maximum particle size of less than 1.7 mm (EP 0 383 482), while a mean particle size of less than 250 μm is specified for the insoluble zinc compound used in a liquid dishwasher composition (EP 0 383 480 and EP 0 387 997).

The disadvantage of the prior art essentially resides in the fact that, because the zinc compounds are not readily soluble or are insoluble, it is difficult to ensure that a sufficient quantity of active agent will be present in the washing or rinsing liquid to protect glassware from corrosion. Furthermore, in view of the high specific density of the insoluble zinc compounds listed, problems of separation arise with powdered mixtures or settlement in the case of liquid mixtures. Finally, all of the known compositions are intended to be active during only one specific stage of the washing cycle, i.e., if admixed with a granular cleanser composition during the washing cycle or if admixed with a liquid rinsing composition with the rinsing cycle. None of the known compositions has the capacity to become and remain active starting from the washing cycle and/or one of the intermediate rinsing cycles onwards

SUMMARY OF THE INVENTION

The underlying objective of the present invention is to resolve at least one and preferably all of the existing problems outlined above.

This objective is achieved by the invention by the use of a ceramic composition to protect glassware from corrosion, the ceramic composition being made using at least one compound which releases an active anti-corrosion agent during the washing and/or rinsing cycles of a dishwasher.

By preference, the compound(s) which release(s) an active agent to prevent corrosion during washing and/or rinsing cycles of a dishwasher is/are selected from the group consisting of the oxides of zinc, aluminum, tin, magnesium, calcium, strontium, silicon, titanium, zirconium, manganese, and/or lanthanum, and/or precursors thereof. In one specific embodiment, the invention proposes that at least one of the compounds used should be zinc oxide and/or a precursor thereof.

By preference, the ceramic composition is used in tablet form. Alternatively, the ceramic composition is used in crushed form, and more preferably in ground form. The ground ceramic composition preferably has an average particle size of at most about 500 μm.

The invention also relates to a composition for use in a dishwasher which contains an active quantity of a ceramic composition in crushed form to protect glassware against corrosion, the ceramic composition being made using at least one compound which releases an active agent to protect glassware from corrosion during washing and/or rinsing cycles of a dishwasher.

The ceramic composition is preferably used in ground form, more preferably with a mean particle size of at most about 500 μm.

The composition proposed by the invention preferably contains the crushed ceramic composition in a quantity of about 0.1 to 10% by weight, more preferably in a quantity of about 0.5 to 5% by weight.

The invention also relates to a composition for use in a dishwasher in the form of a tablet containing an active quantity of a ceramic composition to protect glassware against corrosion, the ceramic composition being made using at least one compound which releases an active agent during washing and/or rinsing cycles of a dishwasher to protect glassware from corrosion.

In one embodiment, the invention proposes that the compound(s) which release(s) an active agent to protect glassware from corrosion during washing and/or rinsing cycles of a dishwasher should be selected from the group consisting of the oxides of zinc, aluminum, tin, magnesium, calcium, strontium, silicon, titanium, zirconium, manganese, and/or lanthanum. In one particular embodiment, the invention proposes that at least one of the compounds should be zinc oxide and/or a precursor thereof.

Finally, the invention relates to a method of inhibiting the corrosion of glassware during washing and/or rinsing cycles of a dishwasher, characterized by the glassware being brought into contact with washing or rinsing water containing an active quantity of the aforesaid composition containing a crushed ceramic composition.

Alternatively, a method of inhibiting the corrosion of glassware during washing and/or rinsing cycles of a dishwasher is proposed, in which the composition described above containing the ceramic composition is provided in tablet form, placed in the interior of the dishwasher at a point which is accessible to the washing and/or rinsing water.

DETAILED DESCRIPTION OF THE INVENTION

Before giving a detailed explanation of the features and advantages of the present invention, it should be pointed out that for the purpose of the present invention, the concept "ceramic composition" should be construed in its broadest sense, namely all materials made up of inorganic and predominantly non-metallic compounds or elements that are crystalline by reference to more than 30% by volume, in particular but not restricted to clay ceramic substances but also glass ceramic substances, for example.

The present invention solves at least one, and in preferred embodiments all the problems inherent in the prior art described above.

By using a ceramic substance as a "base" for one or more reagents to protect glassware from corrosion in a dishwasher, the problem caused by the extensive formation of precipitate from insoluble salts which result in an undesirable deposit, such as occurs with the prior art due to the use of soluble zinc salts for this purpose, are avoided. Instead, the active agents, such as zinc ions, are released from the ceramic compound proposed by the invention into the washing or rinsing water in a delayed release pattern but are not present in a high enough concentration to lead to an extensive and undesirable formation of insoluble salts. The disadvantages of using insoluble zinc compounds described above are avoided by using the ceramic compositions proposed by the invention.

By using the ceramic composition proposed by the invention in ground form as an additive to standard dishwasher products, which are generally made as powders or liquids, the problem of separation described above is also resolved, since the use of a ceramic composition offers greater flexibility in terms of adjusting the specific density requirements.

If the ceramic composition proposed by the invention is provided in tablet form and placed in the interior of the dishwasher at a point which is accessible to the washing and/or rinsing water, e.g. in the cutlery basket, it will also provide, for the first time ever, active protection against corrosion throughout all washing and rinsing cycles, i.e., from the pre-rinse cycle through to the cleaning cycle and then the intermediate rinse cycles through to the final rinse cycle and, what is more, will last for several cycles. As a result, not only is glassware thoroughly protected against corrosion in the dishwasher, handling is made significantly easier and more convenient for the consumer.

If the ceramic composition proposed by the invention is used in crushed form, it may be ground in a grinder specifically suited to this purpose, for example, and an appropriate fraction of particles separated out, e.g. having an average grain particle of at most about 500 μm.

The features of the invention disclosed in the description above and in the claims may be used individually or in any combination to apply the invention in its different embodiments.

The invention will now be described with reference to the following examples.

EXAMPLE 1

In this example a ceramic material with the composition of Table 1 was prepared using the process described below:

TABLE 1

| Component | Mol % |
|---|---|
| $P_2O_5$ | 24 |
| $Na_2O$ | 27 |
| $SiO_2$ | 25 |
| ZnO | 24 |

Process of Preparation:

45 g $Na_3PO_4$ anhydrous, 63 g $NaH_2PO_4$, 21 g $SiO_2$ and 77 g $Zn_3(PO_4)_2$ (all anhydrous) were homogeneously mixed and wetted with a small amount of water during continuous kneading of the mixture until a dough-like plastic mass was obtained. The mass was left to stand for 2 hours at 30° C. during which time the mass swelled due to the development of gas inside. The body was kneaded again to eliminate the gas and close the pores. The resulting mixture was fed into the die of a press machine having a rectangular cross-section of 8×8 $cm^2$. The mixture was pressed to obtain a block. The block dried in about 12 hours at 35° C. to a solid block.

The block was then placed in an electric oven, which was heated to 150° C. at a speed of 50° C./hour. Once the temperature of 150° C. was reached the heating rate was increased to 180° C./hour until a temperature of 780° C. was reached, and this temperature was then maintained for 24 hours. After this period the oven was brought back to room temperature at a rate of 180° C./hour.

EXAMPLE 2

TABLE 2

| Component | Mol % |
|---|---|
| $P_2O_5$ | 25 |
| $Na_2O$ | 30 |
| $SiO_2$ | 15 |
| $ZrO_2$ | 10 |
| CaO | 20 |

The preparation, processing, forming and sintering of this composition was made following the same process explained for Example 1.

EXAMPLE 3

Comparative tests on the glass-protecting performance of the composition of Example 1 were performed as explained below.

Pieces of glassware where washed 50 and 100 times in a dishwashing machine (Miele G540) using for each cleaning cycle 20 g of the commercial dishwashing detergent "Calgonit Ultra 2-Phases Powder" and setting the machine to a program running at 65° C. in the washing cycle and at 65° C. in the rinsing cycle. The water hardness in the dishwashing machine was set to be 0.1° dGH, and the average water consumption per wash was 23.5 L. In the rinsing cycle the machine was set to use 3 ml of the commercial rinse aid "Calgonit Klarspüller" (Calgonite™ Clear Rinse).

The pieces of glassware used for the test were as follows: Luigi Bormioli (Italy)

"linea Michelangelo David" C180, Stemglass, crystal glass ("Michaelangelo"); Verrerie Cristallerie D'Arques (France)

"Luminarc Octime Transparent", Whiskeyglass 30 cl ("Octime"),

"Longchamp" 17 cl; Stemglass, lead crystal glass ("Longchamp"),

"Luminarc Islande Dauphine", 33 cl, decorated long drink glass ("Islande-Dekor"); Ruhr Kristall Glas (Germany):

"Köllner Stange," 24 cl, beer glass ("RKL Kölsch").

New pieces of glassware were used for the test and each was weighted before the test started. After 50 or 100 complete washing cycles the pieces of glassware were removed from the dishwasher and their weight loss was determined gravimetrically.

Additionally the pieces of glassware were visually examined by a panel of trained people in two different environments: at daylight conditions and in a light chamber measuring 70 cm×40 cm×65 cm whose interior is covered with a matt black coating and which is illuminated with an Osram L20W25S-lamp.

The results of the visual examination were recorded using the following scale:

| Value | Evaluation at daylight | Evaluation in light chamber |
|---|---|---|
| 0 | No change | No change |
| 1 | No visible cloudiness | Slight cloudiness |
| 2 | Few visible cloudiness | Considerable cloudiness |
| 3 | Considerable visible cloudiness | Strong cloudiness |
| 4 | Strong cloudiness | — |

The results on glass corrosion of the glassware when no special glass-protecting composition was used are recorded under the heading "Reference." The results obtained when the ceramic composition prepared in Example I was placed in the interior of the dishwashing machine at he start of the test are recorded under the heading "Ceramic."

Gravimetrical determination of glass corrosion

| Glassware | 50 cycles | | 100 cycles | |
|---|---|---|---|---|
| type | Reference | Ceramic | Reference | Ceramic |
| Michelangelo | 41 | 13 | 80 | 28 |
| Octime | 20 | 8 | 38 | 20 |

-continued

Gravimetrical determination of glass corrosion

| Glassware | 50 cycles | | 100 cycles | |
|---|---|---|---|---|
| type | Reference | Ceramic | Reference | Ceramic |
| Longchamp | 62 | 20 | 125 | 44 |
| RKL Kölsch | 25 | 5 | 44 | 14 |
| Islande-Dekor | 378 | 205 | 625 | 398 |

Visual determination of glass damage

| | 50 cycles | | 100 cycles | |
|---|---|---|---|---|
| | Reference | Ceramic | Reference | Ceramic |
| Michelangelo | 2.5 | 1 | 3.5 | 1.5 |
| Octime | 2 | 0.5 | 3 | 1.5 |
| Longchamp | 3 | 1 | 3.5 | 1.5 |
| RKL Kölsch | 2 | 1 | 3 | 1.5 |
| Islande-Dekor | 2.5 | 1 | 3.5 | 2 |

The results from the preceding tables clearly show that the use of the ceramic compositions of the invention substantially reduces the corrosion of glassware when repeatedly washed in a dishwashing machine.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A composition for use in a dishwasher to protect glassware from corrosion, comprising an effective amount of a ceramic composition in tablet form, the ceramic composition comprising compounds which release active agents to inhibit corrosion of glassware during washing and/or rinsing cycles in a dishwasher, wherein the compounds comprise an oxide of silicon and at least one of zinc oxide and a precursor of zinc oxide, and wherein the compounds are present in a quantity of about 0.1 to 10% by weight of the composition.

2. The composition as claimed in claim 1, wherein the compounds are present in a quantity of about 0.5 to 5% by weight of the composition.

3. The composition as claimed in claim 1, wherein the compounds further comprise at least one selected from the group consisting of oxides of aluminum, tin, magnesium, calcium, strontium, titanium, zirconium, manganese, and lanthanum.

* * * * *